US005544604A

United States Patent [19]

Winter

[11] Patent Number: 5,544,604

[45] **Date of Patent: *Aug. 13, 1996**

[54] THREE NEEDLE STITCH WITH COVER THREAD

[75] Inventor: Frank F. Winter, Prospects Heights, Ill.

[73] Assignee: Union Special Corporation, Huntley, Ill.

[ * ] Notice: The term of this patent shall not extend beyond the expiration date of Pat. No. 5,383,414.

[21] Appl. No.: 358,868

[22] Filed: Dec. 19, 1994

Related U.S. Application Data

[63] Continuation-in-part of Ser. No. 63,096, May 17, 1993, Pat. No. 5,383,414.

[51] Int. Cl.[6] ..... D05B 1/08; D05B 93/00

[52] U.S. Cl. ..... 112/475.17; 112/116; 112/199; 112/438; 112/441

[58] Field of Search ..... 112/163, 165, 112/166, 167, 197, 199, 200, 440, 441, 438, 475.01, 475.17

[56] References Cited

U.S. PATENT DOCUMENTS

| | | | |
|---|---|---|---|
| 1,643,406 | 9/1927 | Finch | 112/441 |
| 1,681,458 | 8/1928 | Biddle | 112/199 |
| 1,855,254 | 4/1932 | Moffatt | 112/100 |
| 2,515,038 | 7/1950 | Harper | 112/441 X |
| 3,776,157 | 12/1973 | Szostak . | |
| 4,117,792 | 10/1978 | Navlyt . | |
| 4,175,499 | 11/1979 | Navlyt . | |
| 4,671,195 | 6/1987 | Wolff et al. | 112/166 X |
| 4,917,032 | 4/1990 | Matsumoto . | |
| 5,233,935 | 8/1993 | Winter | 112/261 X |
| 5,383,414 | 1/1995 | Winter et al. | 112/162 |

FOREIGN PATENT DOCUMENTS

| | | | |
|---|---|---|---|
| 510149 | 4/1930 | Germany . | |
| 3346813C2 | 6/1984 | Germany . | |
| 3639390C2 | 2/1987 | Germany . | |
| 4000747C1 | 12/1990 | Germany . | |
| 753951 | 8/1980 | U.S.S.R. | 112/166 |
| 292872 | 6/1928 | United Kingdom . | |
| 294824 | 8/1928 | United Kingdom . | |
| 610365 | 10/1948 | United Kingdom . | |
| 709531 | 5/1954 | United Kingdom . | |

*Primary Examiner*—Paul C. Lewis

*Attorney, Agent, or Firm*—Brinks Hofer Gilson & Lione

[57] ABSTRACT

A method of forming a stitch and the stitch which includes three needle threads and cooperating looper threads for forming three parallel rows of stitches that are joined by a spreader thread that lies on the upper surface of the work piece. The spreader thread follows a serpentine pattern and is configured to lie both forward of and rearward of the penetrating points of the needle threads such that it connects and covers the three parallel rows of stitches.

13 Claims, 5 Drawing Sheets

64
168
84
78
80
82
86
70
76
136
88
92
94
96
98
100
102
104
106
107
108
110
112
114
116
90
120
122
124
126
130
132
134
138

THREE NEEDLE STITCH WITH COVER THREAD

CROSS-REFERENCES

The present application is a continuation-in-part application of application Ser. No. 08/063,096 filed May 17, 1993, entitled "THREE NEEDLE STITCH WITH COVER THREAD," now U.S. Pat. No. 5,383,414. This application is incorporated herein by this reference.

BACKGROUND OF THE INVENTION

This invention relates to a new stitch that is formed along and covers the edge of an upper ply that is joined to a second underlying ply. The invention also relates to a method of forming the new stitch, The new stitch is useful in many applications including a pocket facing application.

This invention has particular application in the pocket facing operation on bluejeans. In this operation an upper layer or ply of denim is stitched, along a raw edge of the denim, to a pocket fabric ply.

In the prior art, the pocket facing operation is performed by applying a facing stitch that has two parallel rows of standard Type 401 stitches with a top cover thread interlaced between the two rows of Type 401 stitches. In this prior art pocket facing operation, the stitch extends straight for a short distance, then follows a radius for about 90°, and then extends straight for another short distance. The prior art facing stitch is started with the right needle just to the right of the raw edge of the upper ply of material. As the stitch is formed around the radius the upper ply tends to twist to the right side, thereby sometimes leaving its raw edge uncovered by the facing stitch. As the garment is worn and washed the uncovered raw edge frays and becomes unsightly. In addition, the covered raw edge, located between the two lines of Type 401 stitches, can also fray up to the line of stitches formed by the left needle after the garment is worn and washed. When this occurs the integrity of the stitch is challenged.

SUMMARY OF THE INVENTION

In accordance with the present invention there is provided a stitch for securing together two superimposed workpieces along an edge of one of the workpieces. The stitch comprises three needle threads, three looper threads and a spreader thread. Corresponding needle and looper threads form three parallel rows of standard Type 401 stitches. The spreader thread lies along the upper surface of the fabric and is interwoven between and connects the three rows of Type 401 stitches. When using this stitch in a pocket facing operation, the row of Type 401 stitch to the right is applied to the right of the edge of the upper ply of fabric so that the stitch covers the edge of the fabric. The stitch of the present invention is produced by employing three fabric-penetrating thread-carrying needles, which are positioned with the left and right needles equally spaced from the center needle.

The three needles lie within a vertical plane which is at an acute angle to the direction of material feed such that the right needle trails the central needle and the central needle trails the left needle. The point of the left and center needles are on the same horizontal plane and the point of the right needle is about ⅛ of an inch above this horizontal plane. As a result of the point of the right needle being above the point of the other two needles, the left and center needles penetrate the fabric simultaneously while the right and center needles penetrate the fabric sequentially rather than simultaneously. The three thread-carrying needles introduce first, second and third needle threads through the workpiece. The respective needle threads are formed into first, second and third needle thread loops which are formed on the underside of the workpiece. Three oscillating thread-carrying loopers interloop looper threads with the first, second and third needle loops for securing the latter in the workpiece thereby uniting or joining the superimposed workpieces.

In a preferred embodiment, the point of the right needle is disposed in a horizontal plane that is above the horizontal plane of the points of the center and left needles. The staggered arrangement of the needle points is compensated for by arranging the oscillating loopers to be at levels corresponding to the needle points.

A modified spreader, an auxiliary spreaders a spreader thread eyelet and a spreader thread guide are coordinated to lay a cover thread on the top surface of the workpiece plies. In this operation, the cover thread interweaves between the three rows of the 401 Type stitch and thus covers the edge of the upper ply.

The new stitch of this invention provides superior coverage to the raw edge of the denim and increases the seam strength as a result of the additional row of Type 401 stitch, which increases the width of the stitch by 50%, from ¼ inch to ⅜ inch. An important advantage of this stitch, especially when used in the pocket facing operation on bluejeans, is that fraying of the margin of the raw denim edge that is located between the left and middle rows of Type 401 stitches is prevented. Fraying of the margin of the raw denim edge located between the middle and right rows of the Type 401 stitches is also reduced since the raw edge need not be positioned as closely to the right needle in the sewing operation as required in conjunction with the two-needle facing stitch. Henceforth, the likelihood of sections of the raw denim edge protruding over the right row of Type 401 stitches is also minimized which in turn inhibits fraying. This not only strengthens the seam but also improves its appearance.

DETAILED DESCRIPTION OF THE PREFERRED EMBODIMENT

Figure 1:
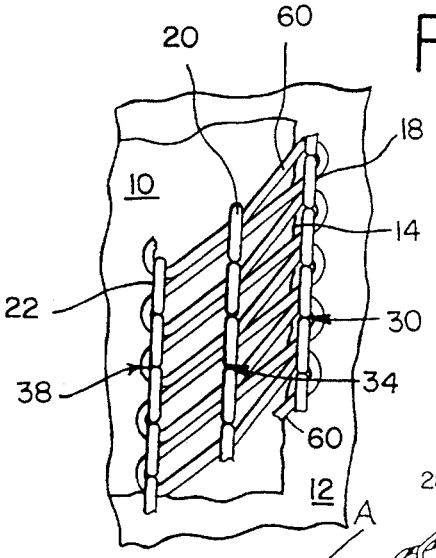
FIG. 1 is a plan view of the stitch applied to overlapping plies of material.

FIG. 1 is a plan view of a sewn product having the stitch of this invention applied to an overlapping ply of material. During the formation of this stitch, two plies of material to be joined are fed through the machine in overlapping relationship, with an upper ply of material 10 located with its edge 14 extending along a non-edge piece of a lower ply 12. Thus, the upper ply of material extends toward the left of its edge 14 and the lower ply 12 extends to the right and the left of edge 14. The stitch spans the edge 14 of the upper ply of material 10 to secure the upper and lower plies and to cover the edge 14. When applied to bluejeans, the upper ply 10 is denim pocket facing material and the lower ply 12 is pocket lining material.

Figure 2:
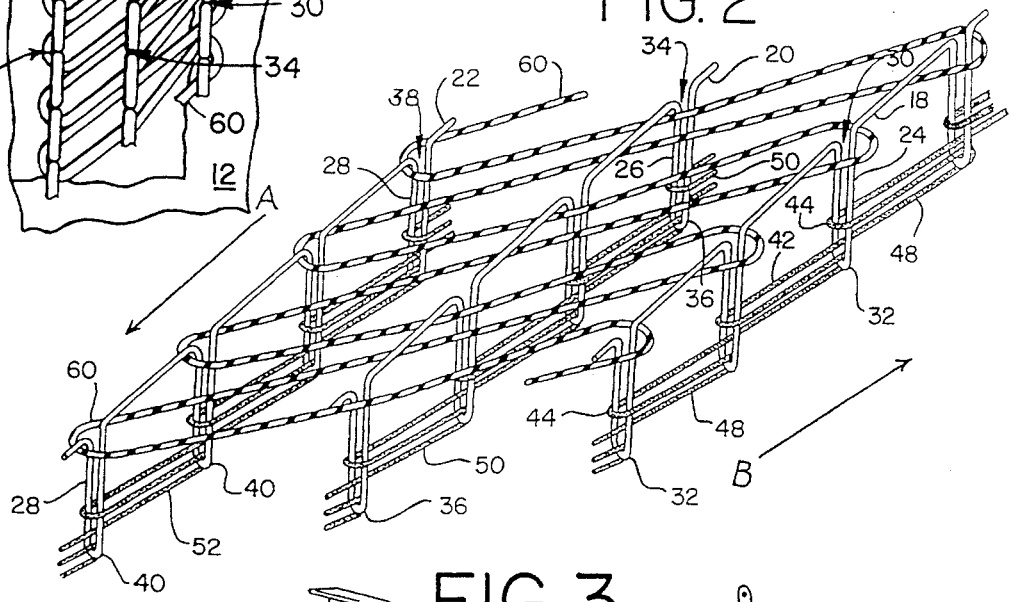
FIG. 2 is a three-dimensional rendering of the threads comprising the stitch.

FIG. 2 is a three-dimensional illustration of the threads comprising the stitch of this invention. The arrow designated A in this view indicates the Direction of Successive Stitch Formation and the arrow designated B indicates the Direction of Feed of Material. The stitch includes three needle threads 18, 20 and 22, three looper threads 48, 50 and 52 and a spreader thread 60. The material plies that are joined by the stitch have not been included in FIG. 2 to better illustrate the stitch formation. The stitch comprises three continuous upper or needle threads 18, 20 and 22 which are formed into right 24, middle 26 and left 28 loops respectively. The needle threads extend along lines that are laterally offset from each other and generally parallel to the edge 14 of the upper ply of material 10.

Referring now to FIGS. 1 and 2, the right loop 24 of right needle thread 18 passes downwardly from its penetration point 30 through the lower ply 12 of material, and extends downwardly to locate the bight portion 32 of the right loop 24 beneath the penetration point 30. The middle loop 26 of middle needle thread 20 passes downwardly from its penetration point 34 through both the upper ply 10 and the lower ply 12 of material, and extends downwardly to locate the bight portion 36 of the middle loop 26 beneath the penetration point 34. The left loop 28 of thread 22 passes downwardly from its penetration point 38 through both the upper ply 10 and the lower ply 12 of material, and extends downwardly to locate the bight portion 40 of the left loop 28 beneath the penetration point 38.

A right looper thread 48 is formed into a loop 42 that passes through the bight portion 32 of the right loop 24 and, as the material is advanced, the bight portion 44 of loop 42 is open and below the penetration point 30 of the next successive stitch of the right needle thread 18. Thus, the bight portion 44 is penetrated by loop 24 of the next stitch formed by thread 18. Thus, the right needle thread 18 and the right looper thread 48 form a standard Type 401 stitch. This first row of Type 401 stitch is formed through only the lower ply 12 of material and follows along the edge 14 of the upper ply of material 10. The middle and left needle threads 20 and 22 cooperate respectively with middle and left looper threads 50 and 52 in the same manner as described above for right needle thread 18 and right looper thread 48 to form standard Type 401 stitches that extend through both the upper 10 and lower 12 plies of material.

A cover or spreader thread 60 is cast on the upper surface of the superimposed workpieces 10 and 12 and interlaced between the needle threads 18, 20 and 22 such that it follows a serpentine path and ties the three standard Type 401 stitches together. As the stitch is being sewn, the spreader thread 60 is cast such that it is in front of the left needle 82 and center needle 80 and behind the right needle 78. (See FIGS. 5 and 5*a*) Thus, in the stitch, the spreader thread 60 is located in front of penetration points 38 and 34 for needle threads 22 and 20, and behind penetration point 30 for needle thread 18. The spreader thread pattern ties the three rows of Type 401 stitches together to form a very effective and useful new stitch.

Figure 3:
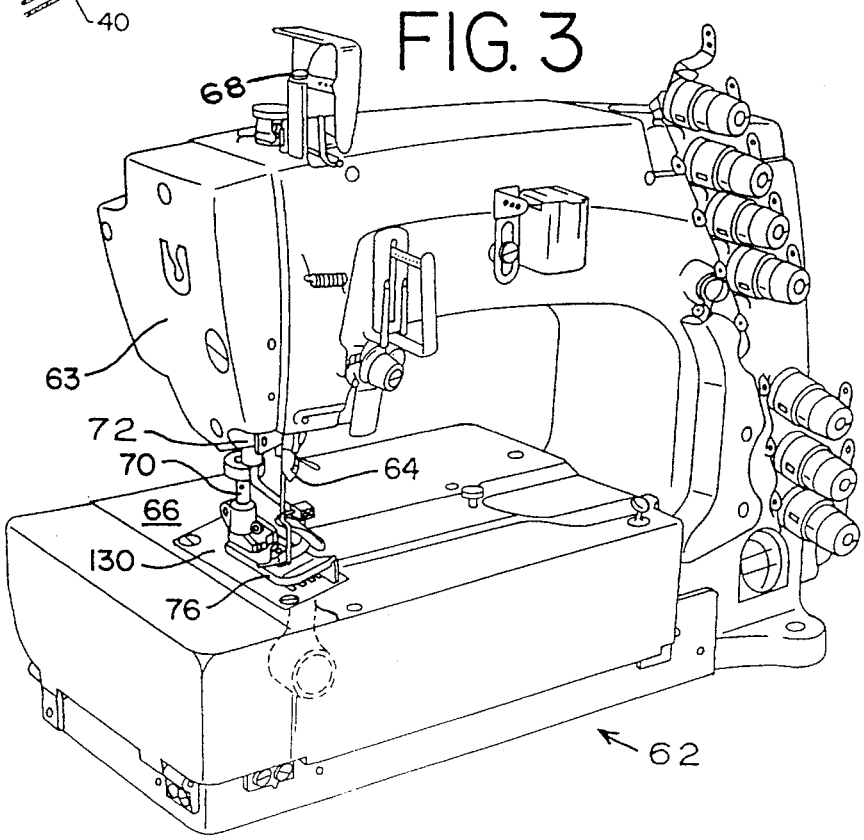
FIG. 3 is a perspective view of a sewing machine of the type that could produce the stitch.

FIG. 3 is a perspective view of a sewing machine 62 of the type that may be used to produce the stitch of this invention. Sewing machine 62 includes a needle head 64, a work supporting surface 66, a reciprocating needle bar 68, a presser foot bar 70 and a throat plate 130. A needle head 64, carrying three needles 78, 80 and 82 (FIG. 5*a*), is secured to the lower end of the needle bar 68 and a presser foot 76 is carried by the lower end of presser foot bar 70. The looper rocker 142 is located below the work supporting surface 66, and is shown in broken lines in this view to depict its relative location in the sewing machine.

Figure 4B:
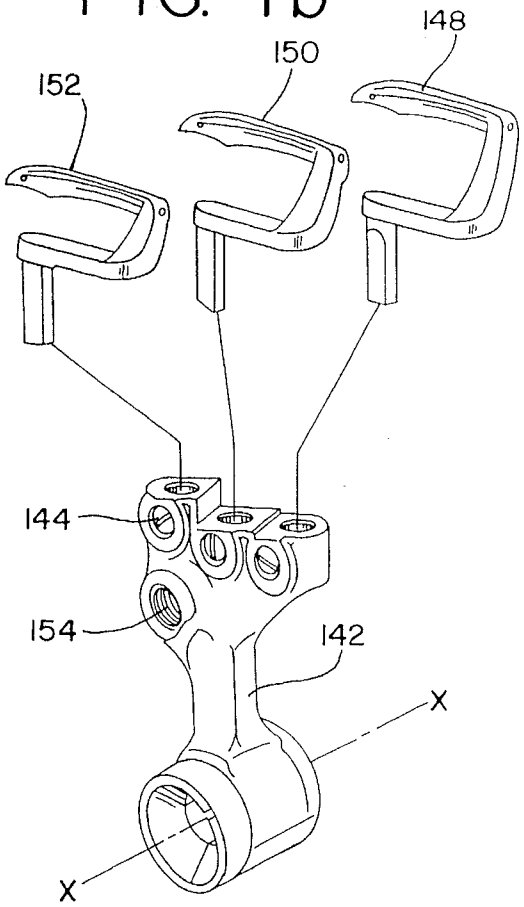
FIG. 4*b* is an isolated perspective view of the looper rocker with the three loopers displaced away from the rocker.
Figure 4:
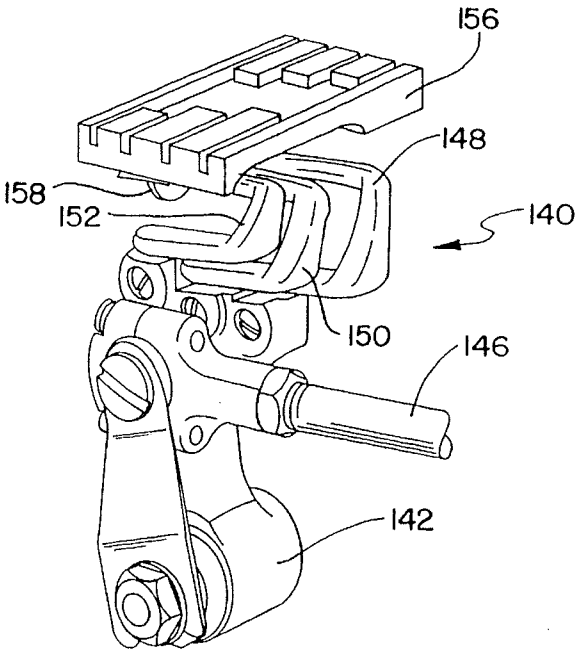
FIG. 4 is a composite view of the oscillating loopers used to produce the stitch.
Figure 4A:
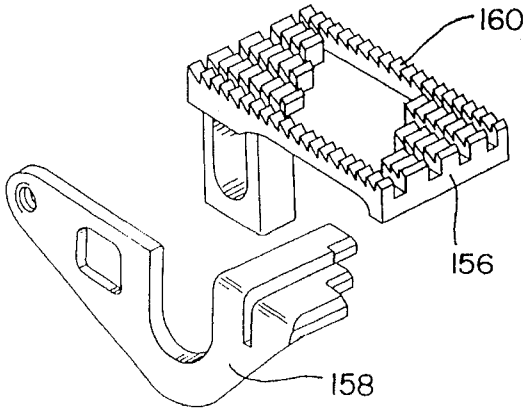
FIG. 4*a* is an isolated perspective view of the feed dog and needle guard.

Referring now to FIGS. 4, 4*a* and 4*b*, a set of loopers 140 is mounted for reciprocal movement below the work supporting surface 66. In FIG. 4, the assembled set of three loopers, right looper 148, middle looper 150 and left looper 152 are shown mounted on the looper rocker 142. The loopers 148, 150 and 152 are secured in adjusted position in the looper rocker 142 by set screws 144. Looper 152 is the front or first looper when looking in the direction of material travel. The loopers are set at a 3/16 inch looper spacing, that is the lateral distance between the loopers is 3/16th of an inch. Viewing from the top, looper 150 is the middle or second looper and its point is about 3/16 of an inch to the right of the point of looper 152. Looper 148 is the rear or third looper and its point is about 3/16 of an inch to the right of the point of looper 150. Viewing from the front, the point of looper 148 is elevated from the points of loopers 150 and 152 by about 1/8 of an inch.

The looper rocker 142 is mounted for oscillating and rocking motion on the sewing machine frame about a pivot axis X—X. Conventional looper rockers that have complex motions, or an axial motion in addition to an oscillating motion, could also be used. A rocker arm 146 is connected to the looper rocker 142 at threaded bore 154 to impart a rocking and oscillating motion to the looper rocker 142.

FIG. 4*b* shows the looper rocker 142 isolated from the other mechanism with the loopers 148, 150 and 152 removed. It is apparent in this view that the loopers 148, 150 and 152 are staggered from front to back. Looking into the direction of work material feed, the left looper 152 is in the foreground, the middle looper 150 is behind the left looper 152 and the right looper 148 is behind the middle looper 150.

The sewing needles 78, 80 and 82 are staggered in the direction of the material feed to permit cooperation between each needle and its associated looper during each stitch. (See FIGS. 5 and 5*a*) Thus, the point of right needle 78 is at a level higher than the points of the left and middle needles 82 and 80 to cooperate with looper 148 which is at a higher level than loopers 150 and 152. As a result, the right needle 78 will penetrate the work material after penetration by the left 82 and middle 80 needles. As a result of the point of the right needle being above the point of the other two needles, the center and right needles penetrate the fabric sequentially rather than simultaneously.

The feed dog 156 in FIG. 4 is located above the set of loopers 140. For simplicity, feed dog 156 is not shown with feed teeth, as in FIG. 4*a*. Also in FIG. 4, a portion of the needle guard 158 is visible.

In FIG. 4*a* the feed dog 156 and the needle guard 158 are shown isolated from the stitch-forming mechanism. Feed teeth 160 are located at the top surface of the feed dog 156. The needle guard 158 protects and prevents the needles 78, 80 and 82 from being deflected behind the loopers 148, 150 and 152.

Figures 5, 5A, 5B, 5C, 5D, 5E, 5F:
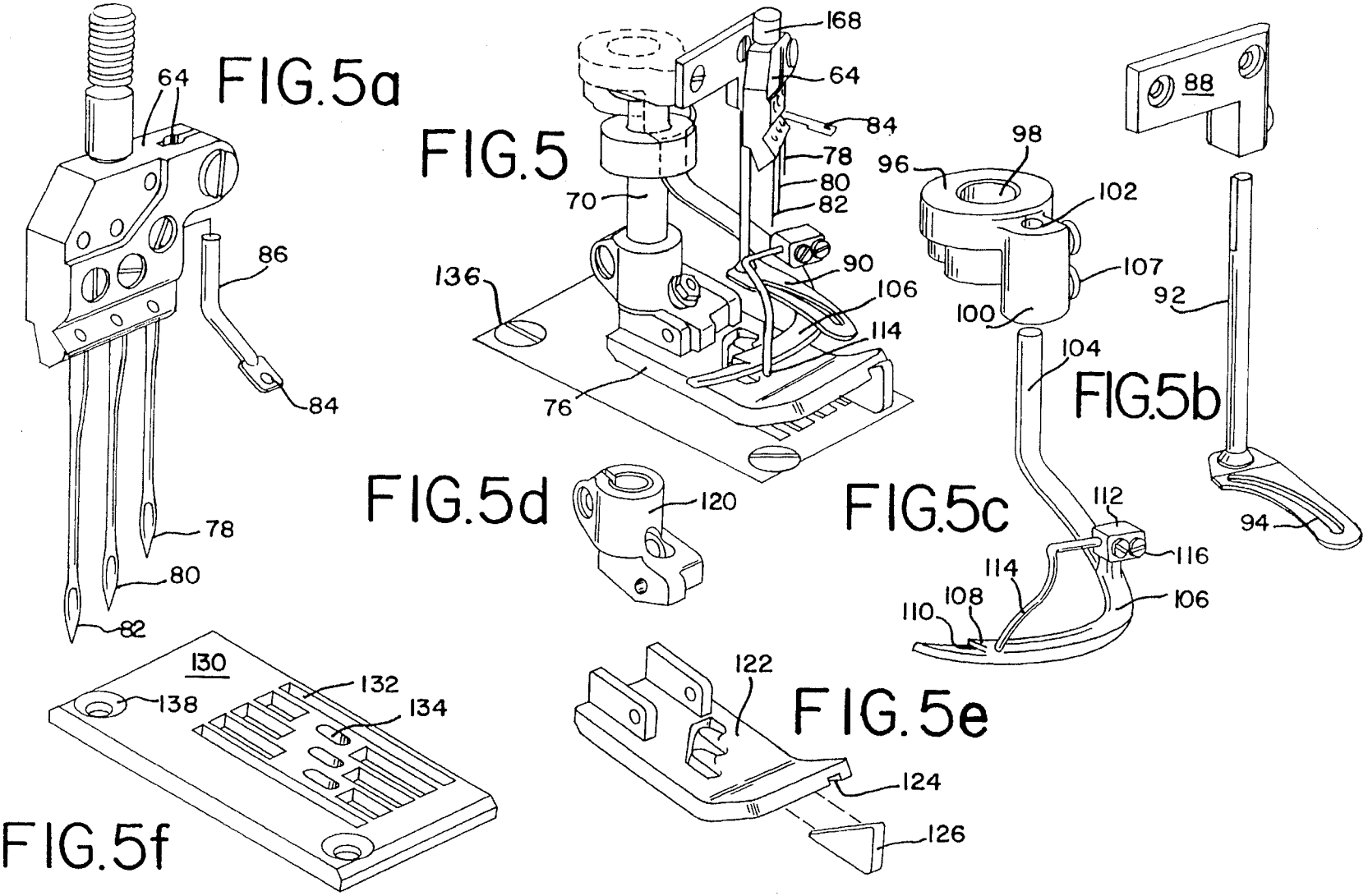
FIG. 5 is a composite view of stitch-forming components that are above the work support surface.
FIG. 5*a* is an isolated perspective view of the needle head.
FIG. 5*b* is an isolated perspective view of the spreader thread guide and its mounting plate.
FIG. 5*c* is an isolated perspective view of the spreader and auxiliary spreader and its holder.
FIG. 5*d* is an isolated perspective view of the presser foot shank.
FIG. 5*e* is an isolated perspective view of the presser foot bottom including the presser foot keel.
FIG. 5*f* is an isolated perspective view of the throat plate.

FIGS. 5, 5*a*, 5*b*, 5*c*, 5*d*, 5*e* and 5*f* illustrate the stitch-forming components generally shown in FIG. 3 that are located above the work supporting surface 66. FIG. 5 is a composite view of all these components in assembled condition and FIGS. 5*a* through 5*f* are isolated views of individual components. The needle head 64 carries three needles, right needle 78, middle needle 80 and left needle 82. The point of right needle 78 is at a higher elevation than the points of left needle 82 and middle needle 80. As shown in FIG. 5, the needle head 64 is at an acute angle to the direction of material travel, such that right needle 78 is the trailing needle and left needle is the leading needle. A spreader thread eyelet 84, through which spreader thread 60 passes, is carried at the end of a rod 86 that is adjustably carried by the needle head 64. The spreader thread eyelet 84 reciprocates along with the needle bar 68.

As shown in FIG. 5*b*, a spreader thread guide mounting plate 88 is secured to the sewing head area 72 (see FIG. 3), and functions to mount the spreader thread guide 90 at the end of rod 92. Spreader thread guide 90 has an elongated arcuate shaped slot 94 formed therein. The spreader thread guide 90 remains stationary during the formation of a stitch.

FIG. 5*c* shows a spreader holder 96 having a vertical cylindrical bore 98, which is mounted for oscillation about a bushing (not shown) within the head of the sewing machine. An oscillator (not shown) causes the spreader holder 96 to oscillate. A lug 100 protrudes radially from the spreader holder 96. The lug 100 has a vertical bore 102 that is sized to receive the top end of the spreader mounting bar 104. A pair of screws 107 is threaded into lug 100 to lock the spreader in a selected position. The spreader 106, is carried at the bottom end of spreader mounting bar 104, and has a generally arcuate shape and lies in a horizontal plane. The spreader 106 has a thread-carrying notch 110 including a point 108 formed thereon. The thread-carrying notch 110 is useful in casting the spreader thread 60 in a serpentine path on the upper surface of the work material.

A mounting hub 112 protrudes upwardly from the spreader 106 and serves to mount an auxiliary spreader 114. The auxiliary spreader comprises a curved wire which extends from mounting hub 112 toward the spreader 106. The auxiliary spreader terminates approximately at thread-carrying notch 110. Screws 116 adjustably secure auxiliary spreader 114 in the mounting hub 112. The operation of the spreader 106 and auxiliary spreader 114 will be explained with reference to FIGS. 6–9.

Referring now to FIGS. 5*d* and 5*e*, the presser foot 76, which is mounted for vertical movement, includes a shank 120 and a bottom portion 122 which is mounted on the shank 120 for pivoting about a horizontal pivot axis. The front end of the presser foot bottom portion 122 is inclined and includes a slot 124 that receives the mounting edge of a presser foot keel 126.

The throat plate 130 depicted in FIG. 5*f* has a plurality of feed dog openings 132 and a set of needle openings 134. The throat plate 130 is set into the work supporting surface 66 and is secured thereto by screws 136 that extend through countersunk holes 138 formed in the throat plate 130.

FIGS. 6, 7, 8, and 9 are a series of views showing the progressive locations of spreader 106 and the auxiliary spreader 114 as the spreader thread 60 is cast along the upper surface of the work material and interlooped with the needle threads 18, 20 and 22. Needles 78, 80 and 82 are shown to illustrate their location relative to the spreader thread 60.

Figure 6:
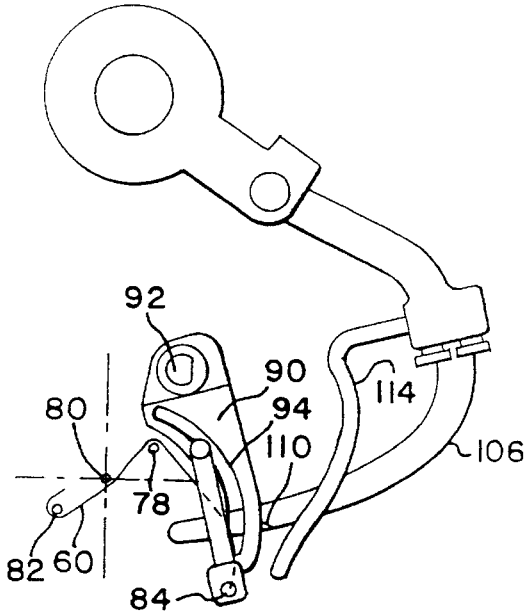
FIG. 6 is a plan view of the start of forward motion of the spreader.

FIG. 6 shows the spreader 106 at its extreme right position when it is about to start its forward motion (to the left). At this point in the cycle, the needle bar 68 is at the bottom of its stroke and the spreader thread 60 extends up from right needle 78, across the front edge of spreader 106, through the arcuate shaped slot 94 in the spreader thread guide 90, through the spreader thread eyelet 84 and from there to its source. The eyelet 84 constrains thread 60 to the end of arcuate shaped slot 94 located at the free end of spreader thread guide 90.

Figure 7:
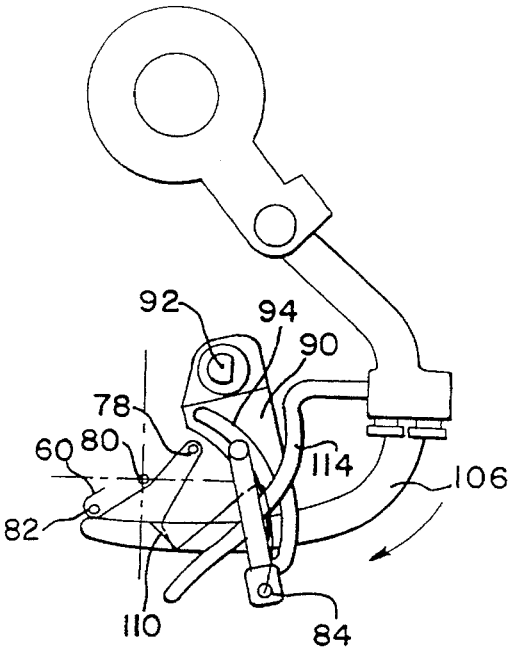
FIG. 7 is a plan view of the middle of forward motion of the spreader.

FIG. 7 shows the spreader 106 in the middle of its forward motion and moving to the left as shown by the directional arrow. At this point in the cycle the needle bar 68 is rising and is located between the bottom and top of its stroke. From the position in FIG. 6, the spreader thread 60 has slid along the rear edge of spreader 106 and has encountered thread-carrying notch 110. Notch 110 catches spreader thread 60 and holds it from further movement along the edge of spreader 106. After spreader thread 60 encounters thread-carrying notch 110, further movement to the left by spreader 106 causes the spreader thread 60 to be pulled to the left. At this stage of the cycle, auxiliary spreader 114 has encountered spreader thread 60. The auxiliary spreader 114 causes the thread to slide along the arcuate shaped slot 94, moving thread 60 toward the rear end of slot 94.

Figure 8:
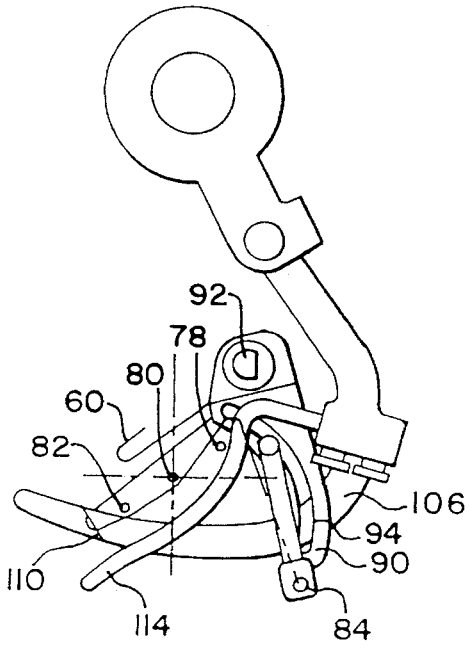
FIG. 8 is a plan view of the end of forward motion of the spreader.

FIG. 8 shows the spreader 106 at the end of its forward motion and at its extreme left position. At this point in the cycle the needle bar 68 is at the top of its stroke. The spreader thread 60 remains in contact with the thread-carrying notch 110 of the spreader 106, and the auxiliary spreader 114 has caused the spreader thread 60 to move past the tip of the right needle 78. As the needle bar 68 moved up from its position in FIG. 7, thread 60 passed under the point of needle 78 while in engagement with the front surface of needles 80 and 82. The thread 60 was moved in this manner because the point for needle 78 is at a higher elevation than the point for needles 80 and 82. This movement of the thread 60 beneath needle 78 is caused by the action of the auxiliary spreader 114 directing spreader thread 60 toward the extremity of arcuate shaped slot 94. Immediately after the needles 78, 80 and 82 reach the top of their cycle they reverse direction, and needles 80 and 82 penetrate the work material on one side of thread 60 and needle 78 penetrates the work material on the opposite side thereof. Needles 80 and 82 pierce the fabric first and prevent the thread 60 from being moved to a location on their back side.

Figure 9:
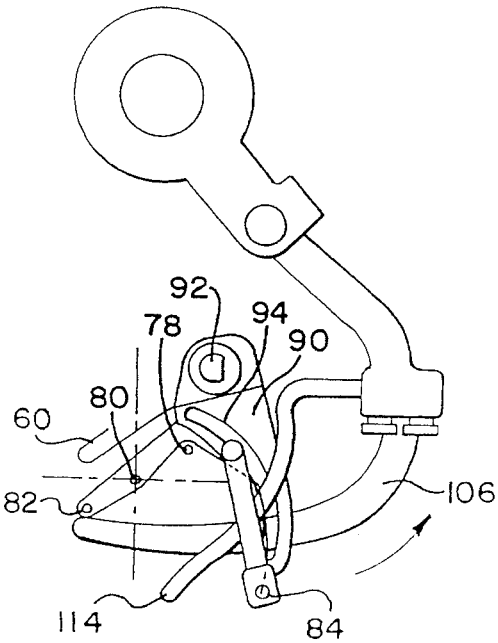
FIG. 9 is a plan view of the middle of the return motion of the spreader.

FIG. 9 shows the spreader in the middle of its return motion and is moving to the right, as shown by the directional arrow. Here the needle bar 68 is moving down. When the spreader 106 reverses its direction the thread 60 is released from the notch 110. As shown in FIG. 9, thread 60 extends from around needle 78 upwardly through the arcuate shaped slot 94, over the left or rear surface of the auxiliary spreader 114, and through the spreader thread eyelet 84. As the auxiliary spreader 114 sweeps to the right, it engages the thread 60 and allows it to slide along the edge of the arcuate shaped slot 94 toward its terminal end, while motion is caused by the eyelet 84. When the spreader 106 reaches its extreme right position (FIG. 6), the thread 60 will have slid off the terminal end of the auxiliary spreader, and the spreader components will have completed a cycle and will have returned to the positions shown in FIG. 6.

Figure 11:
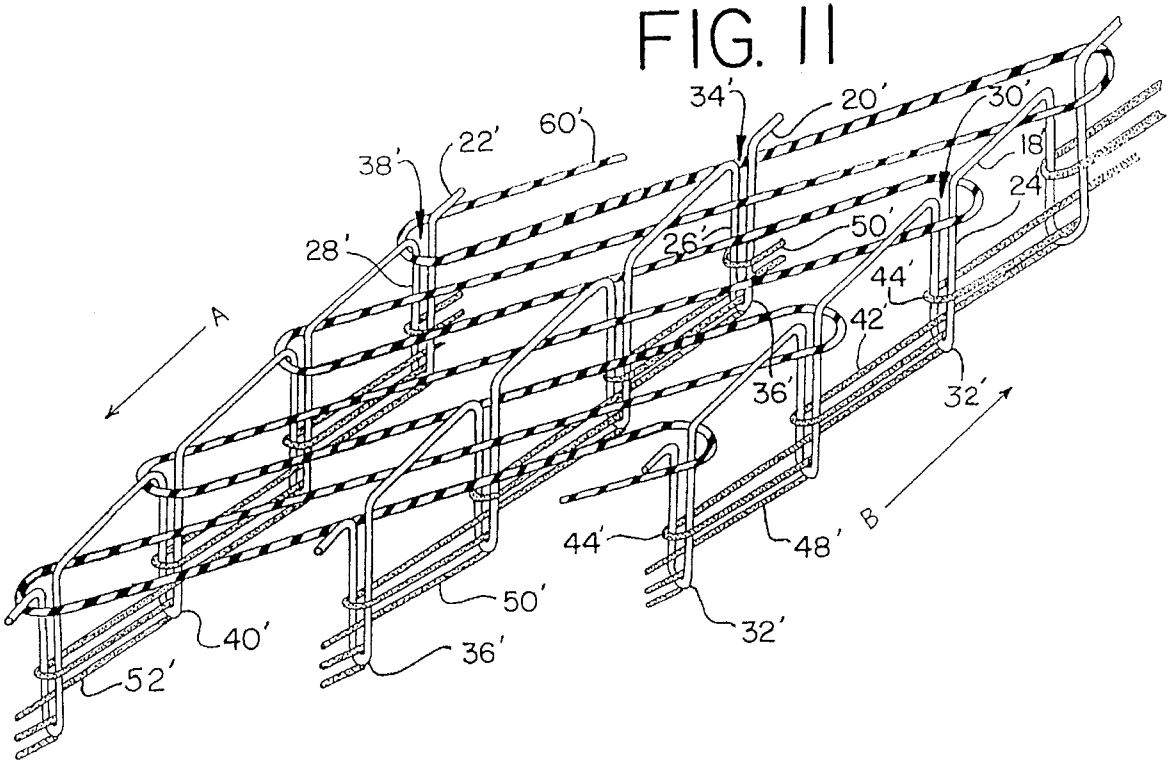
FIG. 11 is a three-dimensional rendering of the second embodiment of the stitch showing the relative position of the threads comprising the stitch.
Figure 10:
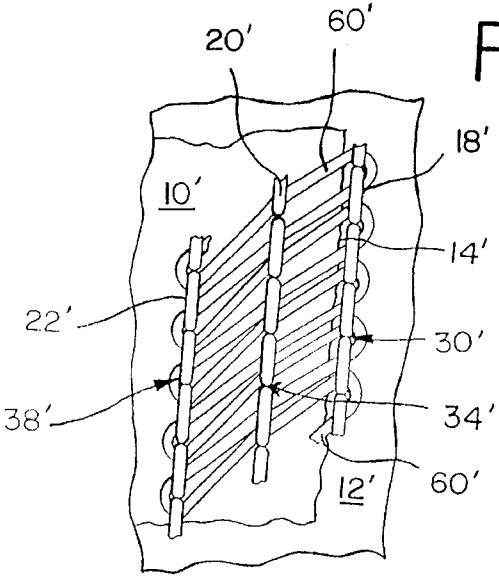
FIG. 10 is a plan view of a second embodiment of the stitch applied to overlapping plies of material.

FIGS. 10 and 11 illustrate a second embodiment of the stitch. This embodiment of the stitch can be formed on a sewing machine of the type disclosed in FIGS. 3–9 herein with a few minor changes. To produce this embodiment of the stitch, the middle needle 80 must be raised up to the level of right needle 78. As a result of the points of the middle and right needle being above the point of the left needle, the left 82 and center 80 needles penetrate the fabric sequentially rather than simultaneously, as they do in the first embodiment of the stitch. Also, the middle looper 150 must be raised to the level of right looper 148, which can be accomplished by lengthening the vertical leg of looper 150. The needle guard 158 must be modified slightly, such that the portion that cooperates with middle needle 80 is raised up to the level of the portion that cooperates with needle 78.

FIG. 10 is a plan view of a sewn product having the stitch of this invention applied to overlapping plies of material. During the formation of this stitch, two plies of material to be joined are fed through the machine in overlapping relationship, with an upper ply of material 10' located with its edge 14' extending along a non-edge piece of a lower ply 12'. Thus, the upper ply of material extends toward the left of its edge 14' and the lower ply 12' extends to the right and the left of edge 14'. The stitch spans the edge 14' of the upper ply of material 10' to secure the upper and lower plies and to cover the edge 14'. When applied to bluejeans, the upper ply 10' is denim pocket facing material and the lower ply 12' is pocket lining material.

FIG. 11 is a three-dimensional illustration of the threads comprising the stitch of this invention. The arrow designated A in this view indicates the Direction of Successive Stitch Formation and the arrow designated B indicates the Direction of Feed of Material. This embodiment of the stitch is formed by three needle threads 18', 20' and 22', three looper threads 48', 50' and 52' and a spreader thread 60'. The material plies that are joined by the stitch have not been included in FIG. 11 to better illustrate the stitch formation. The stitch comprises three needle threads 18', 20' and 22' which are formed into right 24', middle 26' and left 28' loops respectively. The needle threads extend along lines that are laterally offset from each other and generally parallel to the edge 14' of the upper ply of material 10'.

Referring now to FIGS. 10 and 11, the right loop 24' of right needle thread 18' passes downwardly from its penetration point 30' through the lower ply 12' of material, and extends downwardly to locate the bight portion 32' of the right loop 24' beneath the penetration point 30'. The middle loop 26' of middle needle thread 20' passes downwardly from its penetration point 34' through both the upper ply 10' and the lower ply 12' of material, and extends downwardly to locate the bight portion 36' of the middle loop 26' beneath the penetration point 34'. The left loop 28' of thread 22' passes downwardly from its penetration point 38' through both the upper ply 10' and the lower ply 12' of material, and extends downwardly to locate the bight portion 40' of the left loop 28' beneath the penetration point 38'.

A lower right looper thread 48' is formed into a loop 42' that passes through the bight portion 32' of the right loop 24' and, as the material is advanced, the bight portion 44' of loop 42' is open and below the penetration point 30' of the next successive stitch of the right needle thread 18'. Thus, the bight portion 44' is penetrated by loop 24' of the next stitch formed by thread 18'. Thus, the right needle thread 18' and the right looper thread 48' form a standard Type 401 stitch. This first row of Type 401 stitch is formed through only the lower ply 12' of material and follows along the edge 14' of the upper ply of material 10'. The middle and left needle threads 20' and 22' cooperate respectively with middle and left looper threads 50' and 52', in the same manner as described above for right needle thread 18' and right looper thread 48', to form standard Type 401 stitches that extend through both the upper 10' and lower 12' plies of material.

A cover or spreader thread 60' is cast on the upper surface of the superimposed workpieces 10' and 12' and interlaced between the needle threads 18', 20' and 22', such that it follows a serpentine path and ties the three standard Type 401 stitches together. As the stitch is being sewn, the spreader thread 60' is cast such that it is in front of the left needle 82 and behind center needle 80 and right needle 78. (See FIGS. 5 and 5*a*) Thus, in this embodiment of the stitch, the spreader thread 60' is located in front of penetration points 38' for needle thread 22', and behind penetration points 30' and 34' for needle threads 18' and 20' respectively. The spreader thread pattern ties the three rows of Type 401 stitches together to form a very effective and useful new stitch.

While the invention has heretofore been described in detail with particular reference to illustrated apparatus and seams, it is to be understood that variations, modifications and the use of equivalent mechanisms can be effected without departing from the spirit and scope of this invention. It is therefore intended that such changes and modifications be covered by the following claims.

What is claimed is:

1. A seam consisting of a number of stitches, said seam beginning at a starting point and progressing in the direction of stitch formation such that completed stitches are behind the stitch being formed and the stitch being formed is in front of or forward of the completed stitches, each stitch of said seam having a fixed lateral width greater than 20 gauge (5/16 inch) and each stitch comprising:

two outer and a central needle threads formed into three thread loops, each thread loop having a bight portion, said thread loops adapted to penetrate a fabric in a vertical plane arranged at an acute angle to a line defining the lateral width of the stitch;

three looper threads, each corresponding to one of said needle threads, each looper thread passing through the bight portion of a thread loop of the corresponding needle thread and then forming a bight portion through which the next loop formed in the corresponding needle thread passes to form three parallel rows of stitches;

a cover thread, adapted to lay on the top surface of the fabric along a serpentine pattern that is confined to the lateral width of the stitch; and said cover thread looping around the points of penetration of the outer needle threads and includes a cover thread strand portion that connects the looped around portions of the cover thread to connect said three parallel rows of stitches.

2. The invention as set forth in claim 1 in which two of the fabric-penetrating needle thread loops are adapted to penetrate the fabric on one side of said cover thread strand portion and the third fabric-penetrating needle thread loop is adapted to penetrate the fabric on the other side of said cover thread strand portion to connect said three parallel rows of stitches.

3. The invention as set forth in claim 1 in which said fixed lateral width is approximately 24 gauge (3/8 inch).

4. The invention as set forth in claim 2 in which one outer needle thread loop is adapted to penetrate the fabric forward of the cover thread and the other outer needle thread loop and the central needle thread loop are adapted to penetrate the fabric behind the cover thread to connect said three parallel rows of stitches.

5. The invention as set forth in claim 2 in which one outer needle thread loop and the central needle thread loop are adapted to penetrate the fabric forward of the cover thread and the other outer needle thread loop is adapted to penetrate the fabric behind the cover thread to connect said three parallel rows of stitches.

6. A seam consisting of a number of stitches, said seam beginning at a starting point and progressing in the direction of stitch formation such that completed stitches are behind the stitch being formed and the stitch being formed is in front of or forward of the completed stitches, each stitch of said seam having a fixed lateral width greater than 20 gauge (5/16 inch) and functioning to produce a sewn product by joining two workpieces lying in overlapped relationship along the overlapped edge of one of said workpieces, each stitch comprising:

a central needle thread formed into a first row of thread loops passing downwardly through the sewn product at spaced penetration points lying along a line that conform with said overlapped edge;

a left needle thread formed into a second row of thread loops passing downwardly through both workpieces at spaced penetration points lying along a line spaced to the left of said central row of needle thread loops;

a right needle thread formed into a third row of thread loops passing downwardly through the sewn product along a line spaced to the right of said central row of needle thread loops;

looper threads for interlooping with each of said first, second and third rows of needle thread loops to form conforming spaced rows of stitches; and a spreader thread laid along the upper surface of said sewn product and interlocked with said first, second and third rows of thread loops.

7. The invention as set forth in claim 6 in which two of the needle threads are adapted to pass downwardly through the sewn product on one side of said spreader thread and the third needle thread is adapted to pass downwardly through the sewn product on the other side of said spreader thread to connect the three rows of thread loops.

8. The invention as set forth in claim 7 in which said third row of thread loops is adapted to penetrate the sewn product forward of the spreader thread and the first and second row of thread loops are adapted to penetrate the sewn product behind the spreader thread to connect said three rows of thread loops.

9. The invention as set forth in claim 7 in which said first and third rows of thread loops are adapted to penetrate the sewn product forward of the spreader thread and the second row of thread loops is adapted to penetrate the sewn product behind the spreader thread to connect said three rows of thread loops.

10. A method of forming a seam consisting of a number of stitches, said seam beginning at a starting point and progressing in the direction of stitch formation such that completed stitches are behind the stitch being formed and the stitch being formed is in front of or forward of the completed stitches, each stitch of said seam being formed in a product along and over the edge of a first workpiece that is laying in overlapped relationship to a second workpiece comprising the steps of:

laying a cover thread over the surface of the product;

interlocking the cover thread with a first, second and third needle threads by;

passing a first needle thread through the product at points spaced along a line that generally conforms with said edge to form a first series of thread loops;

passing a second needle thread through said first and second workpieces along a line that generally conforms to and is spaced laterally in one direction from said edge to form a second series of thread loops;

passing a third needle thread through the product along a line that generally conforms to and is spaced laterally in the other direction from said edge and is spaced from said second needle thread a distance that is greater than 20 gauge (5/16 inch) to form a third series of thread loops;

interlocking a first looper thread through said first series of thread loops;

interlocking a second looper thread through said second series of thread loops; and interlocking a third looper thread through said third series of thread loops.

11. The method as set forth in claim 10, wherein said first and second needle threads sequentially penetrate the product during each stitch formation.

12. The method as set forth in claim 11 in which said first, second and third needle threads pass through the workpieces along a vertical plane that is at an acute angle to a line extending laterally through the stitch.

13. The method as set forth in claim 10 in which when passing the needle threads through the product two of said thread loops penetrate the product on one side of said cover thread and the other needle thread penetrates the product on the other side of said cover thread to connect said three parallel rows of stitches.

* * * * *